United States Patent [19]

Camp

[11] 4,317,255

[45] Mar. 2, 1982

[54] REPLACEMENT WHEEL ASSEMBLY FOR FREIGHT CAR DOOR AND METHOD OF INSTALLING

[75] Inventor: Douglas M. Camp, Midlothian, Ill.

[73] Assignee: Teams, Inc., Chicago Heights, Ill.

[21] Appl. No.: 111,095

[22] Filed: Jan. 10, 1980

[51] Int. Cl.[3] ..... E05D 13/02

[52] U.S. Cl. ..... 16/102; 105/378

[58] Field of Search ..... 16/100, 102, 99, 97, 16/98, 40, 29, 106, 107; 105/378; 49/426

[56] References Cited

U.S. PATENT DOCUMENTS

| | | | |
|---|---|---|---|
| 591,235 | 10/1897 | Louden | 16/98 X |
| 813,724 | 2/1906 | Luce | 16/97 X |
| 845,134 | 2/1907 | Smith | 16/100 X |
| 930,348 | 8/1909 | Bundy | 16/97 |
| 1,050,656 | 1/1913 | Howard | 16/98 |
| 1,933,090 | 10/1933 | Beauchamp | 16/100 X |
| 3,760,536 | 9/1973 | Wolak | 49/426 |

*Primary Examiner*—Andrew V. Kundrat

*Attorney, Agent, or Firm*—Silverman, Cass & Singer, Ltd.

[57] ABSTRACT

A replacement wheel assembly for railroad freight car doors of the type which utilize a lever and cam arrangement in connection with wheels or rollers mounted on the ends of a bar that can be raised and lowered by manipulation of the lever.

The replacement assembly comprises a wheel mounted on a plate. To install the same, an opening is cut in the side of the freight car door aligned with one of the wheels carried on the ends of the bar, the bar is cut and the original wheel removed from the opening. The replacement wheel of the wheel assembly is slipped into the interior of the door and its mounting plate welded to the outside of the door.

20 Claims, 6 Drawing Figures

REPLACEMENT WHEEL ASSEMBLY FOR FREIGHT CAR DOOR AND METHOD OF INSTALLING

FIELD AND BACKGROUND OF THE INVENTION

The field of this invention is generally sliding doors for railroad freight cars and more specifically this invention relates to a replacement wheel assembly for such freight car doors and the method of installing the same.

One form of railroad freight car door which is used quite extensively in this country is a sliding door that is mounted on rollers or wheels which engage a track alongside of the freight car door. Each door is made out of sheet steel formed and welded together and is quite heavy. The normal complement of wheels for each door is two and these wheels or rollers are mounted on the ends of a bar. This bar is connected to a cam and lever arrangement so that a lever may be manually swung by an operator to raise or lower the bar which in turn raises and lowers both of the wheels.

These freight car doors have chambers formed adjacent to their bottom edges and the bar, cam and wheel arrangement is disposed in the chamber connected to the exterior of the door to enable manipulation thereof. There is a peripheral bottom wall which partially defines the chamber, and slots in the bottom wall aligned with the respective wheels of each pair. With the bar raised, the wheels are retracted into the chamber through the slots and the bottom wall rests upon the track. Other guiding means prevent the door from moving laterally away from the side of the freight car but its weight engaging the track or rail frictionally prevents the freight door from sliding.

When it is desired to move the freight door, the operator grasps the lever and swings it one side or the other thereby pushing the bar downwardly carrying the wheels with it. The wheels move through the slots in the bottom wall of the door against the track or rail and this raises the freight car door. The lever has a relatively short throw from its pivotal point to the cam surface and a relatively long arm serving as its handle so the mechanical advantage enables manual raising of the door. The lever is held in place by the operator who then is enabled to slide the door on its track or rail until he releases the lever.

While it is true that the mechanism is protected from the elements and from being bumped or distorted by merchandise containers, fork lifts and the like, nevertheless, the mechanisms have proved to be unsatisfactory because they wear rapidly and because they are relatively complex and subject to breakage.

Replacing or repairing these mechanisms, and the wheels thereof especially, is a difficult and expensive proposition because obtaining access to the chamber within which the mechanism is disposed requires disassembling the door.

The invention solves the problem by an economical and simple replacement wheel assembly that can be installed without removing the freight car door from its mountings and without use of any complicated procedure.

The invention is concerned with the replacement wheel assembly and the method of using the same to replace an inoperative wheel of a freight car door.

The invention is concerned with the construction of the replacement wheel assembly and the method of using the same to repair or refurbish an inoperative sliding freight car door irrespective of whether an original wheel is broken or inoperative or the mechanism itself is inoperative. In the latter case, both original wheels are removed and replaced by two wheel assemblies of the invention.

SUMMARY OF THE INVENTION

A replacement wheel assembly for a sliding freight car door in which there is a plate provided with a U-shaped bracket secured to one face thereof within the borders of the plate and having a wheel journaled between the bracket and the plate.

A method of replacing the wheel of a freight car door of the type utilizing a cam and bar arrangement with wheels mounted on the end of the bar which comprises cutting an opening in the exterior wall of the freight car door aligned with a wheel on the end of the bar, reaching into the opening and severing the bar as remote from said wheel as possible, withdrawing the severed wheel with its attached section of the bar, raising the door above its track and holding the door in this position, inserting the wheel of the above-described replacement wheel assembly into the interior of the freight car door while placing the plate against the surface of the door, holding the replacement wheel engaged on the track and welding the plate to the outer surface of the freight car door wall and then releasing the door so that the weight of the freight car door rests upon the wheel.

The replacement wheel assembly accomplishes more than the replacement of a wheel; it renders operative a sliding freight car door which is otherwise inoperative. Normally, two replacement wheel assemblies will be utilized.

DESCRIPTION OF THE PREFERRED EMBODIMENT

Generally, the invention should be understood to comprise a replacement wheel assembly which includes a wheel and a mounting plate, the assembly being capable of being sold independently and installed in any desired manner upon a freight car door. In another aspect the invention comprises a method of installing such a replacement wheel assembly upon a freight car door of the type which uses a cam and bar wheel lifting arrangement.

As pointed out above, the replacement wheel assembly can be used to replace the wheel of any freight car sliding door which may have wheels that have broken or become inoperative. The workman cuts a hole in the side wall where the wheel is located, removes the original wheel in some manner and replaces it with the assembly as will be detailed. The door is braced in the proper disposition while the plate of the replacement assembly is welded over the hole.

More important, perhaps, is the benefit which is achieved in the case of the sliding freight car door which has a cam and bar arrangement for raising and lowering the wheels of the door in which the mechanism has become inoperative. Two replacement wheel assemblies are used and when installed, the freight car door is once more operative. In effect, therefore, a substitute has been provided for the inoperative mechanism that is almost impossible to repair or replace.

Figure 1:
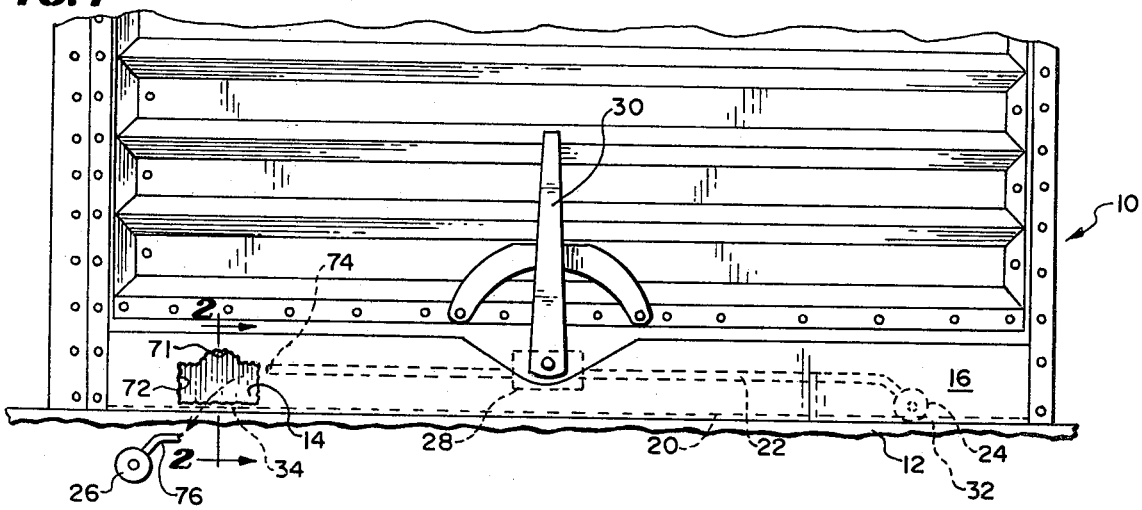
FIG. 1 is a fragmentary side elevational view of a conventional freight car door of the type which utilizes a cam and bar arrangement for raising and lowering the wheels of the door, the door being shown with an opening cut in the side thereof and one of the wheels shown in the process of being removed.

In FIG. 1, there is illustrated a freight car door 10 which is of conventional construction and formed of pressed steel sheet metal welded and/or riveted to provide the rectangular member constituting the door. The usual railroad boxcar type of freight car has side openings which are covered by doors of this type, the doors normally sliding to cover or uncover the side openings of the freight car. In this instance, there is illustrated rail or track 12 which is secured to the side of the freight car below the opening to the car which is not shown. The car door is normally mounted on rollers which engage against the upper edge of the rail 12 to enable the door to be slid along the rail. Suitable confining means to prevent the door from leaving the rail 12 are utilized as well as limiting means to prevent the car door from being slid beyond certain limits.

Figure 2:
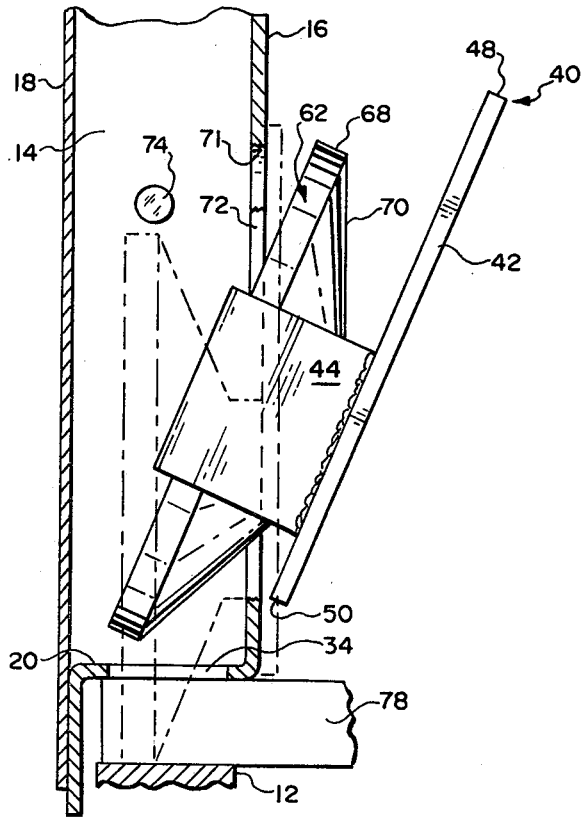
FIG. 2 is a sectional view taken generally along the line 2—2 of FIG. 1 but in this view there is shown an end elevational view of the replacement wheel assembly while being installed.

In FIG. 1 the freight car door 10 is of a known construction which may be termed a cam and bar wheel operating door. The bottom border of the door is provided with a chamber 14 as shown in FIG. 2 formed between a front wall 16 and a rear wall 18, this chamber including a lower peripheral wall 20 which partially defines the chamber 14.

Within this chamber 14 there is provided an elongate bar 22 which mounts a roller or wheel 24 at one end thereof and a second wheel 26 at the other end thereof. In FIG. 1 as will be explained, wheel 26 normally is secured to the left hand end of the bar 22 in the same way that the wheel 24 is secured to the right hand end of the bar 22 but it is shown as having been cut from the bar and in the process of being discarded.

The center of the bar has a cam mechanism 28, the details of which are not illustrated except as a general block in FIG. 1, the cam mechanism 28 being connected to a manually operable handle or lever 30 that is mounted on the exterior wall 16 of the chamber 14. The lever 30 is capable of being swung right or left to force the bar 22 downwardly relative to the car door 10. This movement will force the wheels 24 and 26 to press against the rail 12 through the slots 32 and 34 and thereby will raise the door 10 off the rail 12. The lever 30 is held in place by the operator with the car door 10 raised. In this condition, the operator can manually slide the door. It will be appreciated that in FIG. 1 the car door 10 is resting on the rail 10 and thereby prevented frictionally from sliding. At least its weight prevents ready movement by a workman simply pushing the same. Little force is thus required to lock the door open or closed to obviate casual movement when the door is resting on the rail.

Because this type of mechanism is complex, breakage is frequent. Repair and replacement are difficult because the mechanism is contained within the chamber 14 and freight car doors of this type are assembled by welding and/or riveting. The entire door may have to be replaced as more economical than cutting into the chamber 14 for repair or replacement of the mechanism. Certainly, the time which is lost in either attempting to repair or replace the mechanism on the one hand or in removing the entire door for replacement on the other hand, is substantial, rendering the freight car idle. This represents loss in revenue from the use of the car.

According to the invention replacement of the wheels 24 and 26 is effected by a simple and economical method using a novel type of replacement wheel assembly for this purpose, one such assembly being used to replace each wheel. The wheel assembly of the invention is illustrated in FIGS. 2 through 5. Since it is normal to replace both wheels, although only one may be replaced if desired, the illustrations herein presume that both of the wheels 24 and 26 will be replaced. The construction of the replacement wheel assembly in both cases is the same, two being required for the type of freight car door 10 illustrated.

Figure 5:
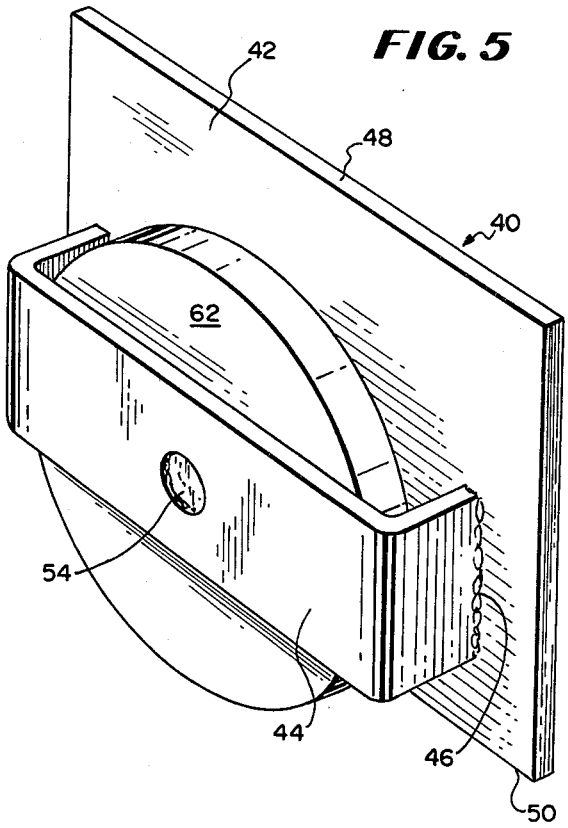
FIG. 5 is a rear perspective view of the replacement wheel assembly showing the wheel and plate.

In FIG. 5 the replacement wheel assembly 40 is illustrated in perspective from the rear thereof. Reference made to the replacement wheel assembly should be taken to include the unitary structure which mounts the wheel per se. The replacement wheel assembly 40 comprises rectangular steel plate 42 that is provided with a U-shaped bracket 44 having a crossbar and side arms. The ends of the side arms opposite the crossbar of the bracket 44 are welded as shown at 46 to the rear surface of the plate 42. The welding is effected in such a manner that the crossbar is substantially parallel to the upper and lower edges 48 and 50, respectively, of the plate 50. The disposition of the bracket 44 relative to the plate 42 can best be seen in FIGS. 2 and 4 wherein it will be noted that the distance from the bracket to the top edge of the plate 42 is much greater than the distance from the bracket 44 to the bottom edge 50 of the plate 42.

A stub shaft 52 extends between the center of the crossbar of the bracket 44 and the plate 42, the bracket being centered relative to the lateral edges of the plate 42. The stub shaft is welded at 54 flush or below the surface of the crossbar of the bracket 44 and emerging from the front surface (right hand as viewed in FIG. 4), of the plate 42 in a tapered conical depression 56 into which it is welded by the weldment 58 shown best in FIG. 4. As a result of this arrangement, the exposed end 60 of the stub shaft 52 is below the surface of plate 42 so that it cannot protrude and catch on anything. The rear 57 of the depression serves as a spacer to confine the wheel 62 laterally.

A wheel or roller 62 is journalled on the stub shaft 52 by means of a roller bearing 64 that is set into a suitable passageway formed in the center of the wheel 62. Any other desirable or convenient bearing arrangement could be used and likewise the replacement assembly 40 may be fabricated by any known techniques.

In order that the wheel 62 be robust and capable of withstanding hard wear and rough treatment, it can be seen that its thickness relatively close to the shaft 52 is much greater than its thickness at its periphery 68, thereby providing a more or less tapered or conical face 70. The conical face 70 is on what may be termed the front of the wheel; that is, the portion which faces the plate 42. This aspect is outwardly of the freight car door when the assembly 40 is installed, as will be understood. The outer periphery 68 of the wheel 62 will be engaged upon the rail 12 and roll thereon during the sliding movement of the door 10. The slots 34 may have narrower dimension than illustrated, the taper of the wheel being advantageous to enable entering such narrower slots.

In replacing the wheels 24 and 26 of the door 10, each is processed independently of the other (although there is nothing to prevent two workmen from working on the wheels simultaneously at opposite ends of the door 10). The first step of replacing a wheel such as 26 is to mark off on the outer surface of the wall 16 of the chamber 14 the area or part of the wall which is to be cut away. In FIG. 1 this area is shown to be generally rectangular with an arcuate upper edge as shown at 71. When the wheel assembly 40 is furnished for replacement purposes templates of the proper shape can be provided in paperboard or thin sheet metal or the like. In use, the template is laid against the outer surface of the wall 16 with the vertical center line of the arcuate upper edge aligned with the center of the wheel 26. This is readily accomplished because the slot 34 and/or the wheel 26 can be seen from the exterior of the freight car door 10. Instructions are given for the distance which the template will be spaced above the bottom edge which coincides with the bottom wall 20 of the chamber 14. This distance will typically be about three quarters of an inch so that when the opening is cut there will be substantial material of the wall 16 remaining below the opening.

Having marked off the shape of the opening in chalk or with any other suitable medium such as, for example, a pointed steel scribe, the opening 72 is cut by means of an acetylene torch or the like and the section of the wall 16 that results is removed and discarded. The configuration of this scrap plate will be the same as the template. The nozzle of the torch is then introduced into the chamber 14 through the opening which has been cut, the operator reaching back as far as he can toward the center of the door, that is, in the direction of the cam mechanism 28, and the bar 22 is cut through as shown at 74. This frees the wheel 26 with a small portion of the bar 22 attached as indicated at 76 and the wheel 26 is removed through the opening 72 and discarded.

The installer now inserts a crowbar or other instrument below the lower edge of the door 10 against the bottom peripheral wall 20 and raises the door. Having raised the door 10, he fixes it in its raised position by any suitable means. For example, a simple way of doing this is to provide blocks of wood or steel such as shown at 78 of the proper thickness inserted beneath the door 10, between it and the rail 12. The block 78 is chosen to have as its thickness the normal spacing of the door 10 above the rail 10 when the door is in sliding condition. The operator or installer now introduces the wheel 62 of the wheel assembly 40 into the opening 72. In FIG. 2 one can see that there is a substantial portion of the wheel 62 that extends below the edge 50 of the plate 42 and that the plate 42 extends a substantial distance above the peripheral edge 68.

The tapered arrangement 70 of the configuration of the wheel 62 facilitates introduction of the wheel through the opening 72, the bottom of the wheel 62 entering the slot 34 and coming to rest on the rail 12 as indicated by the phantom lines in FIG. 2. It is also seen that the upper arcuate formation 71 is conveniently cut in such a manner that the wheel 62 clears the upper edge of the opening by passing through this arcuate portion of the opening 72. The opening 72 is thus capable of being made smaller in its vertical dimension than the maximum diameter of the wheel 62. To summarize, the arcuate portion 71 and the conical shape 70 of the wheel 62 enable the wheel to be maneuvered through an opening in the wall 16 whose vertical dimension is substantially less than the diameter of the wheel 62. In this way, the strength of the wall 16 at the location where the assembly 40 is installed is not decreased any more than absolutely necessary.

Once introduced, it is a relatively simple matter to align the wheel 62 with the center of the slot 34. That is, in the direction of movement of the door 10, and pressing the plate 42 flat against the surface of the wall 16. The thin peripheral edge 68 will be laterally located properly on the rail 12 by virtue of the construction of the assembly 40. There is plenty of room for the wheel laterally because of the narrow periphery thereof. The edge 68 of the wheel 62 will be positioned relatively rearward of the slot 34.

Holding the wheel assembly 40 in this position, the installer runs a line of weldment along the top edge 48 of the plate 42 as indicated at 80, and also applies a similar line of weldment along the sides of the plate 42 as indicated at 82.

As a variation of this method of welding the plate 42 in place permanently, it is feasible to weld the plate 42 to the surface of the wall 16 on all four sides thereof including the bottom edge 50 if the door 10 has been removed and is lying flat in a horizontal disposition, but this is not necessary since the three lines of welding at the sides and on the top edge are sufficient firmly and permanently to anchor and integrate the wheel assembly 40 with the door 10.

After welding the plate 42 in place, the door 10 (assuming that it has been worked on in situ), may be raised slightly by a crowbar and the block 78 removed after which the entire weight of the door at the left hand end will be resting upon the wheel 62 which in turn is engaged upon the rail 12.

Figure 3:
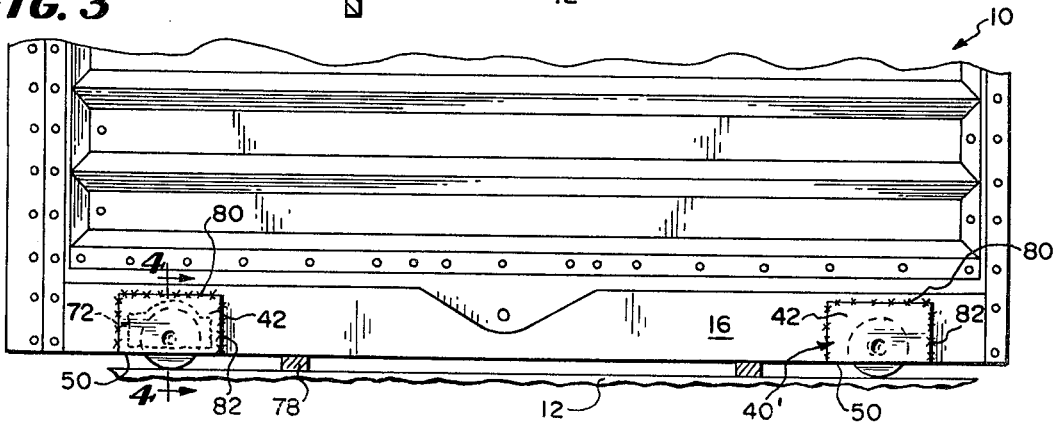
FIG. 3 is a fragmentary side elevational view similar to that of FIG. 1, but in this case two of the replacement wheels have been shown installed in place, the blocking members used in the process not having been removed as yet from beneath the freight car door.
Figure 4:
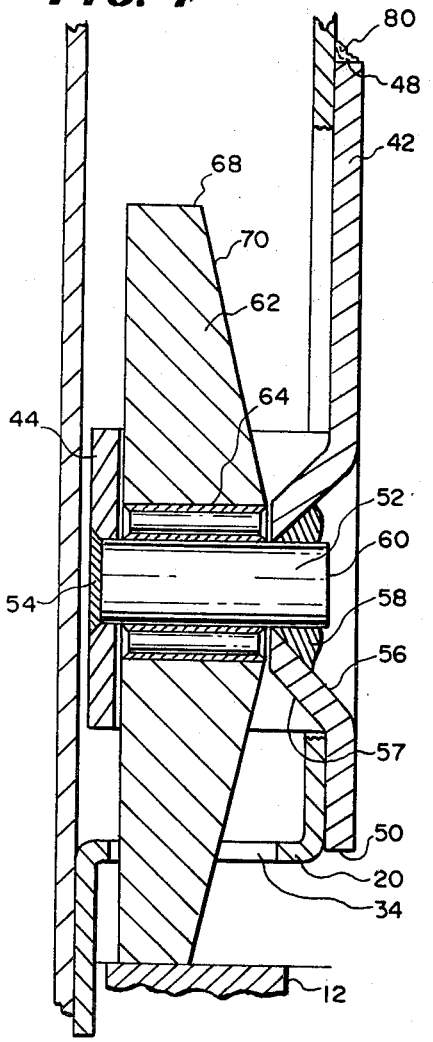
FIG. 4 is a sectional view taken generally along the line 4—4 of FIG. 3 and in the direction indicated.

The wheel 24 may be replaced in the same manner as described in connection with the wheel 26 and in FIG. 3 a second wheel assembly 40 is shown as having been installed in place of the wheel 24. The hand lever 30 may be removed if desired since this furnishes no function after replacement of the wheels 24 and 26 of the cam and bar mechanism, except perhaps to achieve a purchase of the door to cause the same to slide. In any event, the external portions of the cam and bar mechanism are not shown in FIG. 3.

Figure 6:
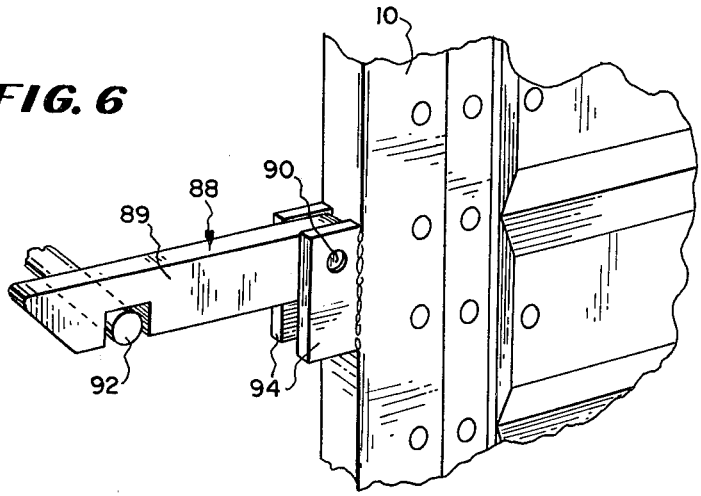
FIG. 6 is a fragmentary perspective view showing a side edge of the freight car door with a device for retaining the door in an open position.

FIG. 6 illustrates a simple latch 88 that may be welded to a side edge of the door 10 and includes a latch arm 89 capable of swinging about the pivot 90 to cooperate with the pin 92, the latter being attached to the freight car side wall. This simple mechanism can be used to hold the door in place in an open position. The latch arm 89 may have the pivot 90 integral therewith cooperating with the small plates 94 that are welded to the side edge of the door 10. All of these parts can be included in a simple kit which will contain the entire wheel assembly 40 along with a template for the opening 72 and printed instructions. The kit may contain two wheel assemblies and a set of parts for the latch mechanism 88.

For economy the wheel 62 is turned from a solid member of steel that can be cold-rolled or billet. It could be sintered, forged or cast if desired.

Variations are capable of being made in the invention and in the method of installation of the wheel assembly without departing from the spirit or scope of the invention as defined in the appended claims.

What it is desired to secure by Letters Patent of the United States is:

1. A wheel assembly for replacing a wheel of the sliding door of a railroad freight car which wheel normally engages a rail on the side of the freight car spaced below the bottom of the door when the door slides, said assembly comprising:

A. a generally rectangular metal plate,

B. a U-shaped bracket having side arms and a crossbar, the U-shaped bracket being secured to the rear surface of the plate by the ends of its side arms, the side arms being spaced inwardly of the side edges of the plate and the crossbar being spaced from the rear surface of the plate, C. a wheel mounted on a stub shaft and journalled between the plate and crossbar, D. the bracket being secured to the plate spaced above the bottom edge of said plate, the rear surface of the plate adapted to be welded over a hole in said freight car door adjacent the bottom edge of said door with the wheel and said bracket on the interior of the door, the wheel being capable of extending through the bottom of the door and into engagement with said rail when the plate is so welded.

2. The wheel assembly as claimed in claim 1 in which the diameter of the wheel with relationship to the bracket position and the dimensions of the plate is such that its lower portion extends a substantial distance below the bottom edge of said plate whereby, if said plate is secured to said door with substantially all of the plate above the bottom of the door the lower portion of the wheel will nevertheless extend below the bottom of the door.

3. The wheel assembly as claimed in claim 2 in which the stub shaft is welded to the crossbar and to the plate and extends across the space between the plate and crossbar and the wheel is journalled on the stub shaft.

4. The wheel assembly as claimed in claim 2 in which the plate has a depression formed therein extending inwardly of the plane of the front surface of the plate, the stub shaft has one axial end connected to the crossbar of the bracket and the second axial end extending into said depression at the bottom thereof from the rear of said plate, said second axial end being connected within said depression and below the said plane of the front surface of said plate.

5. The wheel assembly as claimed in claim 2 in which the wheel is tapered radially outwardly so that its peripheral is narrower than its axial thickness adjacent said stub shaft.

6. The wheel assembly as claimed in claim 2 in which the surface of the wheel which faces the rear surface of the steel plate is conical in configuration.

7. The wheel assembly as claimed in claim 6 in which the surface of the wheel which faces away from the rear surface of the plate substantially lies in a plane normal to the axis of the stub shaft.

8. A wheel assembly for replacing a wheel of the sliding door of a railroad freight car which wheel normally engages a rail on the side of the freight car spaced below the bottom of the door when the door slides, said assembly comprising:

A. a generally rectangular metal plate,

B. a U-shaped bracket having side arms and a crossbar, the U-shaped bracket being secured to the rear surface of the plate by the ends of its side arms, the side arms being spaced inwardly of the side edges of the plate and the crossbar being spaced from the rear surface of the plate, C. a wheel mounted on a stub shaft and journalled between the plate and crossbar, the stub shaft being welded to the crossbar and to the plate and extending across the space between said plate and crossbar and the wheel being journalled on the stub shaft;

D. the bracket being secured to the plate spaced above the bottom edge of said plate, the rear surface of the plate adapted to be welded over a hole in said freight car door adjacent the bottom edge of said door with the wheel and said bracket on the interior of the door, the wheel being capable of extending through the bottom of the door and into engagement with said rail when the plate is so welded.

9. A wheel assembly for replacing a wheel of the sliding door of a railroad freight car which wheel normally engages a rail on the side of the freight car spaced below the bottom of the door when the door slides, said assembly comprising:

A. a generally rectangular metal plate,

B. a U-shaped bracket having side arms and a crossbar, the U-shaped bracket being secured to the rear surface of the plate by the ends of its side arms, the side arms being spaced inwardly of the side edges of the plate and the crossbar being spaced from the rear surface of the plate, C. a wheel mounted on a stub shaft and journalled between the plate and crossbar, D. the bracket being secured to the plate spaced above the bottom edge of said plate, E. the plate having a depression formed therein extending inwardly from the front surface thereof and the stub shaft is connected by one axial end to the crossbar of the bracket and the second axial end extends into and is connected within the depression with said second axial end in the depression below the front surface of the plate, the rear surface of the plate adapted to be welded over a hole in said freight car door adjacent the bottom edge of said door with the wheel and said bracket on the interior of the door, the wheel being capable of extending through the bottom of the door and into engagement with said rail when the plate is so welded.

10. A wheel assembly for replacing a wheel of the sliding door of a railroad freight car which wheel normally engages a rail on the side of the freight car spaced below the bottom of the door when the door slides, said assembly comprising:

A. a generally rectangular metal plate,

B. a U-shaped bracket having side arms and a crossbar, the U-shaped bracket being secured to the rear surface of the plate by the ends of its side arms, the side arms being spaced inwardly of the side edges of the plate and the crossbar being spaced from the rear surface of the plate, C. a wheel mounted on a stub shaft and journalled between the plate and crossbar, the wheel being tapered outwardly so that its periphery is narrower than its axial thickness adjacent said stub shaft, D. the bracket being secured to the plate spaced above the bottom edge of said plate, the rear surface of the plate adapted to be welded over a hole in said freight car door adjacent the bottom edge of said door with the wheel and said bracket on the interior of the door, the wheel being capable of extending through the bottom of the door and into engagement with said rail when the plate is so welded.

11. A wheel assembly for replacing a wheel of the sliding door of a railroad freight car which wheel normally engages a rail on the side of the freight car spaced below the bottom of the door when the door slides, said assembly comprising:

A. a generally rectangular metal plate,

B. a U-shaped bracket having side arms and a crossbar, the U-shaped bracket being secured to the rear surface of the plate by the ends of its side arms, the side arms being spaced inwardly of the side edges of the plate and the crossbar being spaced from the rear surface of the plate, C. a wheel mounted on a stub shaft and journalled between the plate and crossbar, the surface of the wheel which faces the rear surface of the metal plate being conical in configuration, D. the bracket being secured to the plate spaced above the bottom edge of said plate, the rear surface of the plate adapted to be welded over a hole in said freight car door adjacent the bottom edge of said door with the wheel and said bracket on the interior of the door, the wheel being capable of extending through the bottom of the door and into engagement with said rail when the plate is so welded.

12. The wheel assembly as claimed in claim 11 in which the surface which faces away from the rear surface of the wheel of the steel plate substantially lies in a plane normal to the axis of the stub shaft.

13. A method of replacing a wheel of a railroad freight car sliding door, the wheel being disposed within the door and adapted to extend through a slot in the bottom of the door into engagement with a rail that is attached to the railroad car below the door, the exterior of the door being normally imperforate, there being a mounting for the wheel within the door, said door having a certain spacing above the rail when the door is in position for sliding, said method comprising:

A. providing a plate having a rearwardly mounted replacement wheel journalled thereon, B. cutting an opening in the front wall of the railroad car door in alignment with the location of the original wheel to be replaced and of a size that is smaller than the plate but large enough to admit the replacement wheel, C. disconnecting the original wheel from its mounting through the opening and removing said disconnected original wheel out of said opening, D. introducing the replacement wheel of the wheel assembly into the interior of the door through said opening and inserting its bottom portion through said slot by the distance which the door is normally spaced from its rail during sliding condition while bringing the plate into face to face engagement with the exterior of the door about said opening, and E. welding the plate to the exterior of the door.

14. The method as claimed in claim 13 in which the door is provided with a cam and bar mechanism and the mounting of the original wheel comprises a connection with an end of the bar and in which the disconnecting step comprises severing the bar of the cam and bar mechanism near the original wheel whereby the removal of the original wheel also includes a portion of said bar.

15. The method as claimed in claim 13 in which the door is removed from the railroad car before cutting the opening and is laid substantially horizontally and in which the plate is welded to the exterior of the door on all sides thereof.

16. The method as claimed in claim 14 in which the door is removed from the railroad car before cutting the opening and is laid substantially horizontally and in which the plate is welded to the exterior of the door on all sides thereof.

17. The method as claimed in claim 13 in which the door is maintained connected to the railroad car during the execution of the method, the door is raised above the rail to its spacing for normal sliding position and held in that spacing prior to introducing the replacement wheel into said opening, the bottom of the wheel is brought into engagement with said rail, the plate is welded to the exterior of the door on its sides and top edges and the door is released after welding to put its weight on the replacement wheel.

18. The method as claimed in claim 14 in which the door is maintained connected to the railroad car during the execution of the method, the door is raised above the rail to its spacing for normal sliding position and held in that spacing prior to introducing the replacement wheel into said opening, the bottom of the wheel is brought into engagement with said rail, the plate is welded to the exterior of the door in its sides and top edges and the door is released after welding to put its weight on the replacement wheel.

19. The method as claimed in claim 16 in which the cam and bar mechanism includes a second original wheel on another end of said bar and the method is repeated for the second original wheel using a second plate and second replacement wheel.

20. The method as claimed in claim 17 in which the cam and bar mechanism includes a second original wheel on another end of said bar and the method is repeated for the second original wheel using a second plate and second replacement wheel.

* * * * *